United States Patent [19]

White, Jr.

[11] Patent Number: 4,940,401

[45] Date of Patent: Jul. 10, 1990

[54] LUBRICATION FLUID CIRCULATION USING A PISTON VALVE PUMP WITH BI-DIRECTIONAL FLOW

[75] Inventor: Hollis N. White, Jr., Hopkinsville, Ky.

[73] Assignee: White Hydraulics, Inc., Hopkinsville, Ky.

[21] Appl. No.: 310,778

[22] Filed: Feb. 14, 1989

[51] Int. Cl.[5] ..... F04C 2/10; F03C 2/08

[52] U.S. Cl. ..... 418/61.3; 418/102; 417/392

[58] Field of Search ..... 418/61.3, 102; 417/392, 417/388

[56] References Cited

U.S. PATENT DOCUMENTS

| | | | |
|---|---|---|---|
| 3,306,216 | 2/1967 | Warman | 417/392 |
| 3,899,270 | 8/1975 | Swedberg | 418/61.3 |
| 4,493,622 | 1/1985 | Miller | 418/61.3 |
| 4,762,479 | 8/1988 | Uppal | 418/102 |

*Primary Examiner*—John J. Vrablik
*Assistant Examiner*—David L. Cavanaugh
*Attorney, Agent, or Firm*—Woodling, Krost & Rust

[57] ABSTRACT

A lubrication system for the main drive connection of a gerotor device, the lubrication system having a pressure operated piston valve connected directly off of the gerotor cells of the device for bi-directional circulation of fluid therethrough.

15 Claims, 3 Drawing Sheets

LUBRICATION FLUID CIRCULATION USING A PISTON VALVE PUMP WITH BI-DIRECTIONAL FLOW

This invention relates to the lubrication of the drive connection and other drive parts of a pressure device.

Historically most lubrication fluid circulation has been produced by providing a fluid bypass loop between the pressure and return lines for the pressure device. U.S. Pat. Nos. 4,362,479 — Rotary Fluid Pressure Device and Lubrication Circuit Therefor, 4,480,479 — Gerotor Motor and Case Drain Flow Arrangement Therefor, and 3,572,983 — Fluid Operated Motor are examples of fluid bypass units. These units are relatively complicated, needing many sets of valves and many additional fluid passages in order to operate.

OBJECTS OF THE INVENTION

It is an object of this present invention to provide a simple lubrication fluid circulation.

It is an object of this present invention to provide for a reliable lubrication fluid circulation.

It is an object of this present invention to reduce the cost of lubrication fluid circulation.

Other objects and a more complete understanding of the invention may be had by referring to the drawings in which:

DRAWINGS

FIG. 1 is a longitudinal cross-sectional view of a pressure device incorporating the invention of the application.

FIG. 2 is an enlarged view of the fluid pump ball and cavity of FIG. 1,

FIG. 3 is a cross-sectional view of the ball opening of FIG. 1 taken generally along lines 3—3 or that figure, and FIG. 4 is an enlarged view like FIG. 2 showing a spring loaded fluid pump ball.

DESCRIPTION OF THE DRAWINGS

The invention relates to the lubrication fluid circulation over a drive connection and the other drive parts of a pressure device. The invention will be described in its preferred embodiment of providing a lubrication circulation in a Closed Center Hydraulic Device. The construction and operation of the basic device is described in my U.S. patent application closed center hydraulic device, Ser. No. 080606 filed Aug. 3, 1987, and its continuation Ser. No. 282675, filed Dec. 12, 1988, now U.S. Pat. No. 4,877,383.

The closed center device 10 includes a porting plate 11, a multi-plate manifold 12, a gerotor structure 13, a mounting plate 14, a wobblestick 15, an orbiting valve 16 and a drive connection 17.

Figure 1:
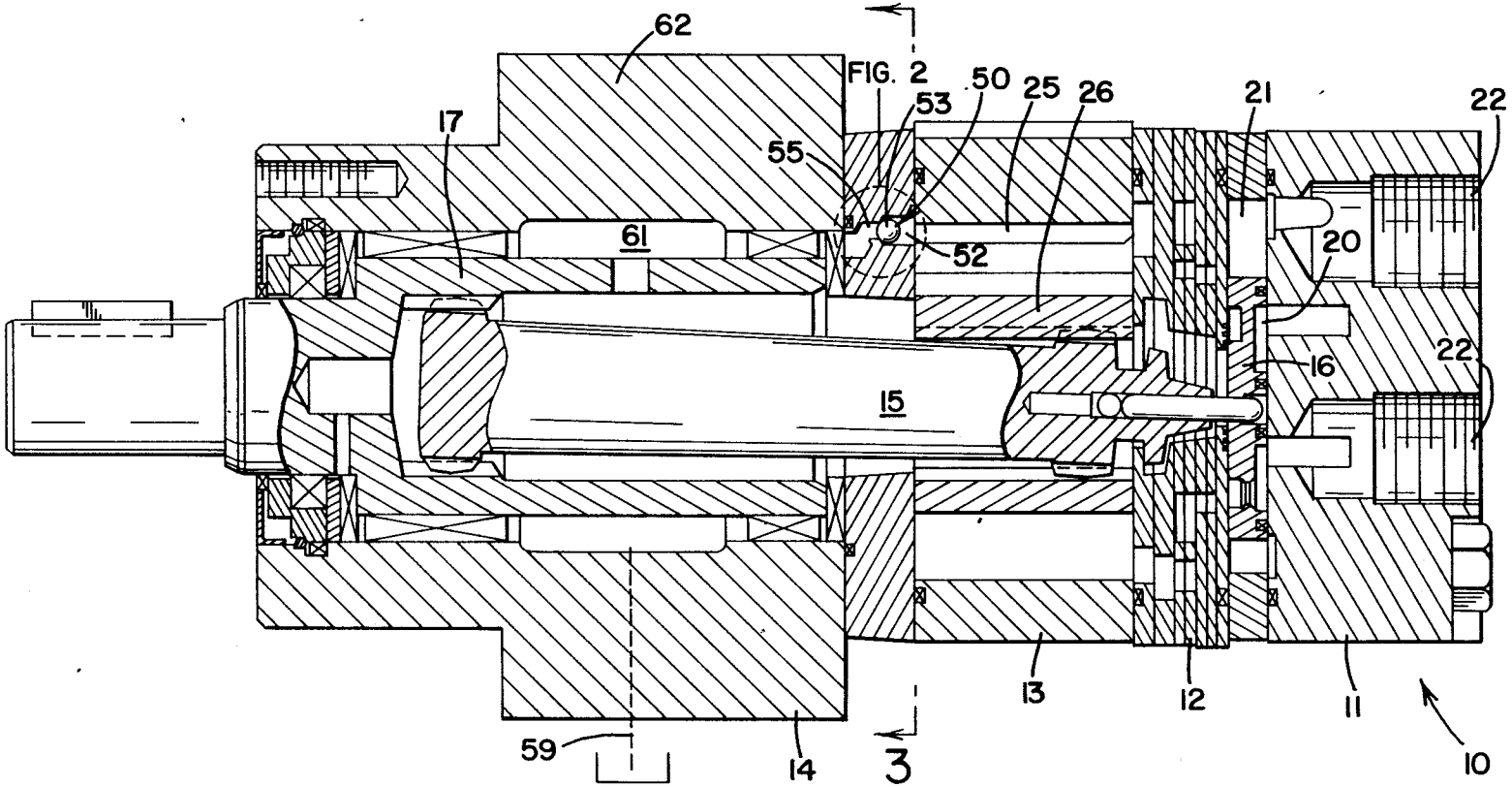

In general operation the porting plate 11 interconnects the inner 20 and outer 21 sections of the orbiting valve 16 to the pressure and return ports 22 (which is pressure and which is return depends on the desired direction of rotation of the device 10). The orbiting valve 16 in turn selectively interconnects its inner 20 and outer 21 sections to the expanding and contracting gerotor cells 25 of the gerotor structure 13 through the manifold 12, the selective interconnection depending on the positioning of the orbiting valve 16 in respect to such manifold 12. This valving in turn orbits and rotates the rotor 26 of the gerotor structure 13, moving the wobblestick 15 to provide an output power and to move the orbiting valve 16 through its selective valving positions to further operate the device 10. This operational fluid is isolated from the rest of the device, in specific the inside of the mounting plate 14. Once per every rotation of the wobblestick 15 any individual gerotor cell 25 is subjected to a cycle of higher then lower pressure. Although the exact pressure differential depends on the efficiency, friction etc. of the particular device, for purposes of this application the differential will be considered to be equivalent to that between the pressure and return lines to the device 10.

Figure 2:
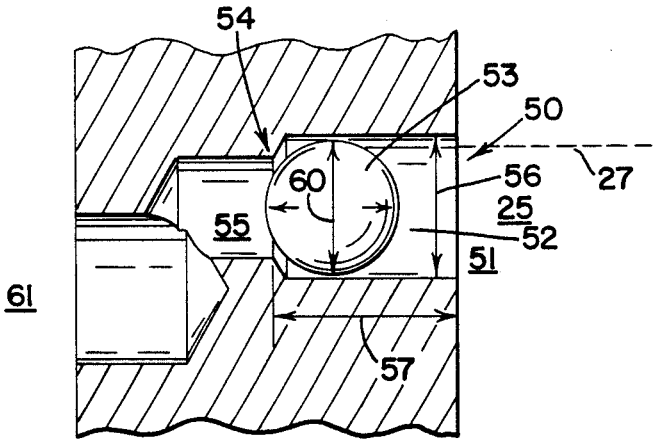
Figure 3:
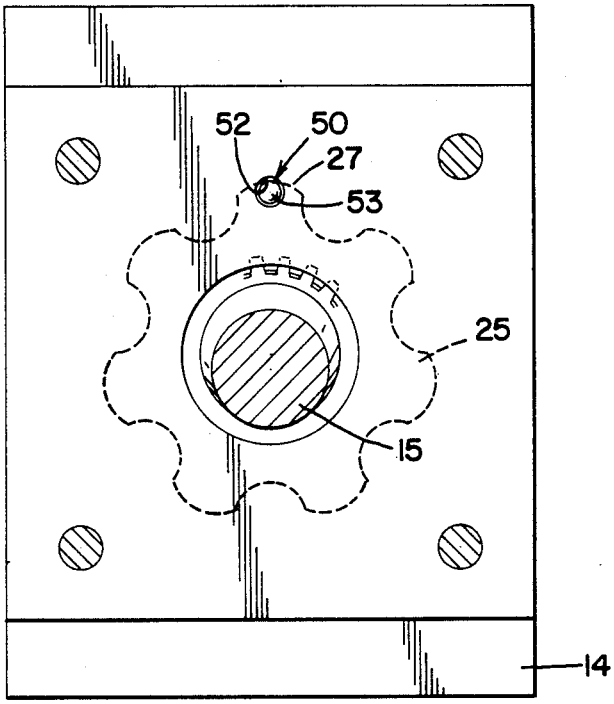

The invention of this present application utilizes this pressure cycle between higher and lower pressure to parasitically pump lubrication fluid over the wobblestick 15 and through the drive connection 17. The invention accomplishes this with a piston valve 50 (FIGS. 2 and 3).

The piston valve 50 includes an opening 51, a piston cavity 52, a piston 53, a valve seat 54 and an exit 55.

The opening 51 of the piston valve 50 connects the piston cavity 52 to a gerotor cell 25 that is subject to the pressure and return pressure differential.

The preferred piston cavity 52 disclosed is a cylindrically shaped hole having a certain diameter 56 and a length 57. These two dimensions are chosen in consideration of the piston 53 (later described) to provide a certain displacement having certain known operating characteristics to match the desired result. For example the larger the diameter 56 and/or the shorter the length 57 of the piston cavity 52 the faster the piston valve 52 will operate. Additional example the smaller the diameter of the piston 53 in respect to the diameter 56 the piston cavity 52 the slower the piston valve 50 will operate (and the less the length of the piston cavity 52 will have an effect on the volume of fluid pumped). Other variations are possible as are modified shapes, external loadings etc. to produce a desired result. In the preferred embodiment disclosed the piston cavity is 0.255 inches in diameter and 0.325 inches in length.

Figure 4:
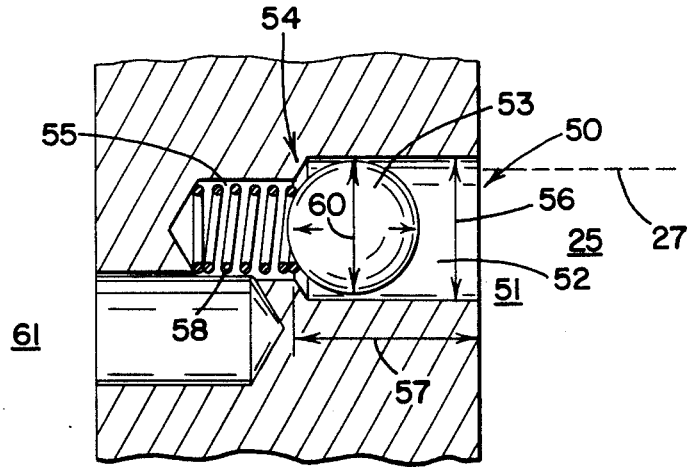

The piston 53 is a member located within the piston cavity 52 so as to provide the pumping action. To accomplish this the piston 53 is designed in consideration with the piston cavity 52 and the pressures and availability of fluid. There is a continuous leakage of fluid past the piston 53 (preferably only when the piston 53 is not seated on the valve seat 54 later described). This leakage is preferably provided by making the diameter 60 of the piston 53 slightly smaller (a few thousandths) than the diameter 56 of the piston cavity 52. A bypass notch or other means could also be used to provide the desired selective bypass leakage. The piston 53 itself is preferably moved within the piston cavity 52 between the opening 51 and exit 55 due to the pressure variation in the piston cavity 52. Note, however, that in certain applications an external loading or force might also be included. For example by incorporating a spring 58 into the piston valve 50 (in FIG. 4) the piston 53 would unseat from the valve seat 55 while the piston 53 is still subjected to a pressure of 250 p.s.i. This could be beneficial under certain circumstances (examples later described). Some means is to be provided to insure that the piston 53 does not pass through the opening 51 into the interconnected gerotor cell 25 (This would jam and/or damage the gerotor structure 13). In the preferred device disclosed this non-escape means is created by having the lip 27 of the gerotor cell 25 slightly overlapping the opening 51 such as to reduce the effective size of the opening 51 to smaller than the size of the piston 53. Other means could also be used. The preferred ball piston disclosed is 0.250 inches in diameter with a 0.005 inch leakage crescent between the ball piston and the 0.255 inch diameter surface of the piston cavity 52.

The valve seat 54 is located between the piston cavity 52 and the exit 55. The valve seat 54 cooperates with the piston 53 to stop all fluid from passing out of the piston cavity 52 after a set amount of fluid has been passed through the exit 55. The set amount of fluid is determined primarily by the certain displacement (previously set forth) of the piston cavity 52 in consideration also of the time for operation and leakage past the piston 53 and other factors (such as external loading). (The use of a valve seat 54 is preferred rather than a continuous leakage so as to reduce the parasitic drain on the operating efficiency of the gerotor structure 13. Note, however, that since the drive opening 61 (later described) is separately sealed a total closure is not absolutely necessary.

The exit 55 of the piston valve 50 is connected to the drive opening 61 in the mounting plate 14 wherein the wobblestick 15 and drive connection 17 reside. The drive opening 61 itself is a preferably sealed blind cavity having no outlet. The fluid within this opening is in a state of constant eddy and flow due to the rotation of the drive connection 17, the shifting of the wobblestick 15, the pumping effect of the bearings for the device 10 and the other motion taking place within the drive opening 61.

The piston valve 50 is preferably designed such that at the normal range of operating pressures and volume sufficient fluid is circulated through the drive opening 61 to adequately cool and lubricate the various parts therein. For this reason the disclosed valve is designed to close against the seat 54 (i.e. pump the full volume of the fluid within the cavity 52) at the normal operating minimum pressure differential. At higher or the normal operating maximum pressure differentials this same disclosed valve will continue to pump this fluid, albeit quicker with some additional direct fluid bypass. The pumping action of the valve therefore insures the needed fluid circulation while also the seating limits parasitic losses for the device and increased pressure differentials in the drive opening 61 under more stressful but nevertheless expected operating conditions. This increases operating efficiencies while also reducing the sealing requirements for the drive opening 61. Note that modifications may be desirable for certain applications. For example the incorporation of an external loading biasing spring 58 would greatly increase the effectiveness of the pump 50 upon conditions of downstream loading and/or reduced pressure swings in the device. This is especially so if the unseating force on the exit 55 side of the piston 53 is limited (i.e. for a 2000–150 p.s.i. pressure swing with only 100 p.s.i. unseating force the piston 53 would never unseat from the valve seat 54 without an external force). An external loading biasing spring 58 would also increase the volume of fluid pumped through an otherwise openable device (by increased open time).

In operation (beginning with the gerotor cell 25 at return pressure) the piston 53 is near the opening 51 side of the piston cavity 52 with fluid on the exit 55 side thereof. As the pressure in the gerotor cell 25 increases the piston 53 moves toward the exit 55, pushing some of the fluid in the cavity 52 through the exit 55. Some new fluid also passes through the clearance by the piston 53 to also pass directly between the opening 51 and exit 55. All of this fluid blends into the moving fluid of the drive opening 61 so as to disperse within it. Eventually the piston 53 is moved sufficiently in order to seat on the valve seat 54. At this time no more fluid passes out of the exit 55 and the piston cavity 52 acts as a blind pocket adjunct to the gerotor cell 25 throughout the rest of the pressurization cycle. As soon as the return cycle begins the piston 53 is unseated from the valve seat 54 and begins to return towards the piston cavity opening 51 following the fluid leaving the gerotor cell 25. External loading (such as the spring 58) would delay the seating of the piston 53 on closing and speed the unseating of the piston 53 on the opening due to the additional force applied by such loading (and under certain conditions may provide the unseating forces). Due to the resiliency of the fluid within the drive opening 61 and the pressure existing on the exit 55 side of the piston 53 some fluid leaks by the piston 53 in both directions on this return towards the piston cavity opening 51 to recreate the fluid within the cavity 52 on the exit 55 side of the piston 53 while allowing the piston ball 53 to return to its initial position. After a period of time the gerotor cell 25 again begins to pressurize and the cycle starts again. In the preferred embodiment disclosed this piston ball 53 pump moves about 0.050 to 0.075 inches per cycle to circulate approximately half a gallon of new fluid per minute through the drive opening 61, lubricating and cooling the wobblestick 15 and drive connection 17.

Although this invention has been described in its preferred form with a certain degree of particularity, it is to be understood that numerous changes may be had without deviating from the invention as hereinafter claimed. For example the preferred embodiment disclosed utilizes a single piston valve 50 in a gerotor hydraulic motor. The piston valve 50 could in fact be made multiple (for increased or varied circulation) or it could be utilized with a different type of cyclable pressure operated device (a vane pump for example). Additional example the drive opening 61 is described as preferably a sealed blind cavity. The addition of an outlet 59 to this cavity would increase the fluid circulation through this opening 61 (The outlet 59 would preferably have a capacity slightly less than that of the pump 50 to insure that the opening 61 was normally filled with fluid). The addition of an outlet is an example of a situation where a spring 58 may be necessary for the operability of the device — with an outlet (or a very large opening 61) there could otherwise be insufficient pressure on the exit 55 side of the piston 53 to unseat such piston 53 from the valve seat 54 against the residual pressure on the opening 51 side. These and other changes do not deviate from the invention as claimed.

What is claimed is:

1. In a pressure device having a pressure cell subjected to a pressure varying between lower and higher pressures and a drive connection in an internal cavity, the improvement of a piston valve comprising a piston cavity, said piston cavity extending between the pressure cell and the internal cavity, a piston, said piston being movably located within said piston cavity, bypass means for a small amount of fluid to leak past said piston, and said piston moving in said piston cavity to pump fluid bi-directionally into and out of the internal cavity.

2. The piston valve of claim 1 characterized in that said piston cavity has a diameter, said piston has a diameter, said diameter of said piston being smaller than said diameter of said piston cavity with a gap therebetween and said bypass means including said gap between said piston and said piston cavity.

3. In a pressure device having a pressure cell subjected to a pressure varying between lower and higher pressures and a drive connection in an internal cavity, the improvement of a piston valve comprising a piston cavity, said piston cavity extending between the pressure cell and the internal cavity, a piston, said piston being movably located within said piston cavity, bypass means for a small amount of fluid to leak past said piston, said piston being movable in said piston cavity to move fluid bi-directionally into and out of the internal cavity, a valve seat, said valve seat being located between said piston cavity and the internal cavity, and said piston being seatable on said valve seat so as to prevent fluid from passing into the internal cavity from said piston cavity after a certain volume of fluid has passed thereinto for a given variance between lower and higher pressures of the pressure cells.

4. The piston valve of claim 1 characterized in that the drive connection circulates fluid within the internal cavity.

5. The piston valve of claim 1 characterized by the addition of a stop means to retain said piston within said piston cavity.

6. In a pressure device having a pressure cell subjected to a pressure varying between lower and higher pressures and a drive connection in an internal cavity, the improvement of a piston valve comprising a piston cavity, said piston cavity extending between the pressure cell and the internal cavity, a piston, said piston being movably located within said piston cavity, bypass means for a small amount of fluid to leak past said piston, said piston being movable in said piston cavity to move fluid bi-directionally into and out of the internal cavity, and an external loading means biasing said piston away from the internal cavity.

7. The piston valve of claim 3 characterized by the addition of a loading spring and said spring biasing said piston off of said valve seat.

8. In a pressure device having a pressure cell subjected to a pressure varying between lower and higher pressures and a drive connection in an internal cavity, the improvement of a piston valve comprising a piston cavity, said piston cavity extending between the pressure cell and the internal cavity, said piston cavity having a length, a piston, said piston being movably located within said piston cavity, said piston having a length, said length of said piston cavity being greater than said length of said piston, bypass means for a small amount of fluid to leak past said piston, and said piston moving in said piston cavity to pump fluid bi-directionally into and out of the internal cavity.

9. The piston valve of claim 8 characterized in that said piston cavity has a unitary diameter about said piston, said piston has a diameter, said diameter of said piston being smaller than said unitary diameter of said piston cavity with a gap therebetween and said bypass means includes said gap between said piston and said piston cavity.

10. The piston valve of claim 8 characterized by the addition of a stop means between the piston cavity and the pressure cell to retain said piston within said piston cavity and said stop means allowing fluid to pass therethrough at all times.

11. In a pressure device having a pressure cell subjected to a pressure varying between lower and higher pressures and a drive connection in an internal cavity, the improvement of a piston valve comprising a piston cavity, said piston cavity extending between the pressure cell and the internal cavity, a valve seat, said valve seat being located between said piston cavity and said internal cavity, a piston, said piston being movably located within said piston cavity, bypass means for a small amount of fluid to leak past said piston, and said piston moving in said piston cavity to pump fluid bi-directionally into and out of the internal cavity through said piston cavity.

12. The piston valve of claim 11 characterized in that said piston cavity has a unitary diameter about said piston, said piston has a diameter, said diameter of said piston being smaller than said unitary diameter of said piston cavity with a gap therebetween and said bypass means includes said gap between said piston and said piston cavity.

13. The piston valve of claim 11 characterized in that piston cavity has a length, said piston has a length, and said length of said piston cavity being greater than said length of said piston.

14. The piston valve of claim 11 characterized by the addition of a loading spring and said spring biasing said piston off of said valve seat.

15. The piston valve of claim 11 characterized by the addition of a stop means between the piston cavity and the pressure cell to retain said piston within said piston cavity, and said stop means allowing fluid to pass therethrough at all times.

* * * * *